US010104924B2

(12) United States Patent
Dassler et al.

(10) Patent No.: US 10,104,924 B2
(45) **Date of Patent: *Oct. 23, 2018**

(54) CYCLING GLOVE AND SUPPORT AREA PADS

(76) Inventors: Alfred K. Dassler, Hollywood, FL (US); Robert M. Schwartz, Miami, FL (US); Albert J. Hofeldt, Miami Beach, FL (US)

( * ) Notice: Subject to any disclaimer, the term of this patent is extended or adjusted under 35 U.S.C. 154(b) by 1351 days.

This patent is subject to a terminal disclaimer.

(21) Appl. No.: 13/250,860

(22) Filed: Sep. 30, 2011

(65) Prior Publication Data

US 2012/0076985 A1 Mar. 29, 2012

Related U.S. Application Data

(63) Continuation-in-part of application No. 12/879,183, filed on Sep. 10, 2010, now Pat. No. 8,065,750.

(60) Provisional application No. 61/388,137, filed on Sep. 30, 2010, provisional application No. 61/325,481, filed on Apr. 19, 2010, provisional application No. 61/241,063, filed on Sep. 10, 2009.

(51) Int. Cl.

| | |
|---|---|
| ***A41D 19/00*** | (2006.01) |
| ***A41D 19/015*** | (2006.01) |
| ***A63B 71/12*** | (2006.01) |
| *A63B 71/14* | (2006.01) |

(52) U.S. Cl.

CPC .... *A41D 19/01523* (2013.01); *A63B 71/1225* (2013.01); *A63B 71/141* (2013.01); *A63B 2071/125* (2013.01); *Y10T 428/24479* (2015.01); *Y10T 428/24752* (2015.01); *Y10T 428/249921* (2015.04)

(58) Field of Classification Search

CPC ..... A41D 19/01523; A63B 71/1225
USPC ..... 2/16, 161.1, 161.6, 20, 163, 455
See application file for complete search history.

(56) References Cited

U.S. PATENT DOCUMENTS

| | | | | |
|---|---|---|---|---|
| 3,741,411 | A | 6/1973 | Peacock | |
| 3,940,811 | A | 3/1976 | Tomikawa et al. | |
| 4,370,754 | A | 2/1983 | Donzis | |
| 4,432,099 | A * | 2/1984 | Grick et al. | 2/412 |
| 4,577,625 | A | 3/1986 | Lohati et al. | |
| 4,605,582 | A | 8/1986 | Sias et al. | |
| 4,673,605 | A | 6/1987 | Sias et al. | |
| 4,843,738 | A | 7/1989 | Masuda | |
| 5,065,457 | A | 11/1991 | Henson | |
| 5,500,956 | A | 3/1996 | Schulkin et al. | |
| 5,537,688 | A * | 7/1996 | Reynolds et al. | 2/20 |
| 5,643,656 | A | 7/1997 | Lin | |
| 5,771,901 | A | 6/1998 | O'Brien | |
| 6,093,468 | A * | 7/2000 | Toms et al. | 428/67 |
| 6,289,571 | B1 | 9/2001 | Minkow et al. | |
| 6,425,194 | B1 | 7/2002 | Brie | |
| 6,589,891 | B1 * | 7/2003 | Rast | 442/1 |

(Continued)

FOREIGN PATENT DOCUMENTS

KR 10-0487752 5/2005

*Primary Examiner* — Katherine Moran
(74) *Attorney, Agent, or Firm* — Robert M. Schwartz; Alfred K. Dassler

(57) ABSTRACT

A support element including a padding structure constructed of a plurality of interconnected spherical shaped structures together defining a pliable support element. The spherical shaped structures are interconnected to one another with a connection defining flexible interconnectors for enabling the padding structure to be flexibly bent.

7 Claims, 18 Drawing Sheets

(56) References Cited

U.S. PATENT DOCUMENTS

| | | | | |
|---|---|---|---|---|
| 6,618,860 | B1 | 9/2003 | Sullivan et al. | |
| 7,013,588 | B2 | 3/2006 | Chang | |
| 7,234,170 | B2 * | 6/2007 | Simic | 2/16 |
| 7,346,935 | B1 * | 3/2008 | Patterson | 2/239 |
| 7,707,654 | B1 | 5/2010 | Spence | |
| 7,865,969 | B2 | 1/2011 | Auger et al. | |
| 2005/0230205 | A1 | 10/2005 | Springler et al. | |
| 2006/0070171 | A1 * | 4/2006 | Copeland et al. | 2/455 |
| 2008/0035442 | A1 | 2/2008 | Springler et al. | |
| 2008/0083050 | A1 * | 4/2008 | Baker et al. | 2/161.8 |
| 2008/0282438 | A1 * | 11/2008 | Boutaghou | 2/16 |
| 2010/0098915 | A1 | 4/2010 | Hanlon | |

* cited by examiner

CYCLING GLOVE AND SUPPORT AREA PADS

CROSS-REFERENCE TO RELATED APPLICATIONS

This application claims the benefit of U.S. Provisional Application Ser. No. 61/241,063, filed on Sep. 10, 2009, entitled Cycling Glove, U.S. Provisional Application Ser. No. 61/325,481, filed on Apr. 19, 2010, entitled Cycling Glove, U.S. Provisional Application Ser. No. 61/388,137, filed on Sep. 30, 2010, entitled Pressure Location Pad and Non-Provisional U.S. patent application Ser. No. 12/879,183, filed Sep. 10, 2010, published Mar. 10, 2011 as Pub. No.: US 2011/0055995 A1 entitled Cycling Glove Support Area, these prior applications are incorporated herein by reference in their entirety.

BACKGROUND OF THE INVENTION

Field of the Invention

The invention relates to a support surface for articles which contact body parts, more specifically, for padding in articles such as cycling gloves, gloves, shoes, insoles, socks, seats, protective pads and padding and the like.

Description of the Related Art

Existing cycling gloves typically are made of leather, vinyl and nylon and include a Velcro® closure for securing the glove to the hand. Many gloves include cushion members or padding on the palm area of the hand. The padding is usually made of foam or gel enclosed between the layers of the palm of the glove.

The disadvantages of existing padding in cycling gloves is that the cushion members are constructed to be very soft (in the range of hardness on the Shore OO scale) and become easily compressed between the user's hands and the handlebars of the bicycle. The cushion offers no support and thus often causes numbness in the hands and fingers of the rider and over time possible nerve damage to the rider's hands. Numbness may typically be caused by the pressure generated on the hand by the handle bars while riding. Additionally, the handlebars compress and deform the padding because of the small contact area of the handlebar on the glove. This further deteriorates the ability of the glove to protect the hand from the handlebars. Particularly, the handlebars of most bicycles are round metal or carbon fiber bars. The handlebars may be covered with a foam or cushion tape or elastic handlegrips that attempt to reduce the hardness of the bar with respect to the rider's hands. However, the use of cushioning on the bar or glove is not a successful solution, as evidenced by the high number of riders that experience continued numbness/tingling in the hands and or fingers during and after riding. Accordingly, a long-standing problem for cyclists is the problem of numbness/tingling in the hands and fingers when riding for extended periods of time.

SUMMARY OF THE INVENTION

It is accordingly an object of the invention to provide cycling gloves which overcome the above-mentioned disadvantages of the heretofore-known devices and methods of this general type and which provides a padding support element that is comfortable.

With the foregoing and other objects in view there is provided, a glove including a palm portion formed of flexible material. The palm portion has at least one support area. The support area having a plurality of ball shaped elements.

In accordance with another feature of the invention, the plurality of ball shaped elements are disposed in a matrix pattern.

In accordance with an added feature of the invention, the palm portion is constructed of at least two layers. The ball shaped elements are disposed between the at least two layers.

In accordance with an additional feature of the invention, the ball shaped elements are disposed in rows within flexible sleeves.

In accordance with yet an additional feature of the invention, the ball shaped elements are interconnected by flexible strings passing through the ball shaped elements.

In accordance with yet another added feature of the invention, the glove includes a cavity defined at least partially by the palm area for receiving a human hand. A continuous padding layer is disposed between the cavity and the ball shaped elements.

In accordance with still another added feature of the invention, the ball shaped elements each have a respective center and diameter. Directly adjacent ones of the ball shaped elements are disposed with the centers spaced apart by a distance less than twice the diameter.

In accordance with yet still another added feature of the invention, at least some of the directly adjacent ball shaped elements directly contact one another.

In accordance with yet still another further feature of the invention, at least some of the ball shaped elements are hemispherical.

With the objects of the invention in view, there is also provided a padded glove including a glove body formed with a cavity for inserting a human hand and having a palm wall for covering a palm of the hand. A padding structure is mounted to the palm wall for padding the palm and preventing or alleviating fatigue of the palm caused by extended pressure on the palm of the hand. The padding structure is constructed of a plurality of interconnected spherical shaped structures which together define, a pliable support element.

In accordance with still a further feature of the invention, at least some of the interconnected spherical shaped structures are hemispherical projection substantially disposed in a matrix pattern.

In accordance with still another feature of the invention, the spherical shaped structures are a multiplicity of balls interconnected to one another with a connection defining flexible interconnectors for enabling the padding to be flexibly bent.

In accordance with yet an additional feature of the invention, the spherical shaped structures are formed of a material having a shore hardness of 50-95 Shore A.

In accordance with yet an added feature of the invention, the palm wall is a double wall with an inner layer and an outer layer. The padding structure is disposed between the inner layer and the outer layer.

In accordance with yet a further feature of the invention, the double wall is formed with a plurality of pockets between the inner layer and the outer layer, and each the pocket is filled with a respective the padding structure.

In accordance with yet a further feature of the invention, the padding structure is configured and maximized for supporting the hand on a handle bar.

With the foregoing and other objects in view there is provided a cycling glove including a support region having a plurality of spaced apart ball shaped support elements arranged in close proximity to one another. One or more support regions are arranged on the palm portion of the glove, the support regions have the ball shaped support elements held in place by tubular arrangements. The tubular arrangements are disposed side by side such that each ball is adjacent one or more other balls. The balls create a protective barrier between the hand and the handlebar or wherever the hand is placed.

Additionally, there is provided, in accordance with the invention, a cycling glove including a support region defined by a plurality of rigid plate or ball-shaped support elements. The support elements may be interconnected to one another by flexible connectors, or arranged independent of one another but held in close relationship.

In one embodiment of the glove the support area conforms to the shape of a handlebar with a small surface area and distributes the load over a larger surface area. The glove is also very suitable for use in other activities such as weight lifting exercise where heavy amounts of weight are supported by the palms of the hands, such as bench presses, military presses or other exercises in which a bar supported by the palm of the user's hand. The support region allows the heavy weight load to be distributed more evenly over the palm. Additionally, the glove is flexible enough so that it is comfortable to wear and provides a responsive feel to the user. The hinge construction of the support regions allows the hands of the rider to be comfortably positioned with any orientation relative to the handlebars or any position on the handlebars.

Additionally, there is provided, in accordance with the invention, a support element including a padding structure constructed of a plurality of interconnected spherical shaped structures together defining a pliable support element. The spherical shaped structures are interconnected to one another with a connection defining flexible interconnectors for enabling the padding structure to be flexibly bent.

In accordance with still another feature of the invention, at least some of the ball shaped elements are hemispherical.

In accordance with yet still another feature of the invention, there is a walled containment. The padding structure is disposed within the walled containment.

In accordance with yet an added feature of the invention, the spherical shaped structures are formed of a material having a shore hardness of 20-95 Shore A.

In accordance with yet an additional feature of the invention, at least some of the interconnected spherical shaped structures are hemispherical projections substantially disposed in a matrix pattern.

In accordance with yet a further feature of the invention, the ball shaped elements each have a respective center and diameter. Directly adjacent ones of the ball shaped elements are disposed with the centers spaced apart by a distance less than twice the diameter.

In accordance with still yet a further feature of the invention, the ball shaped elements each have a respective center and diameter. Directly adjacent ones of the ball shaped elements are disposed with the centers spaced apart by a distance greater than twice the diameter.

Other features which are considered as characteristic for the invention are set forth in the appended claims.

Although the invention is illustrated and described herein as embodied in a padding element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
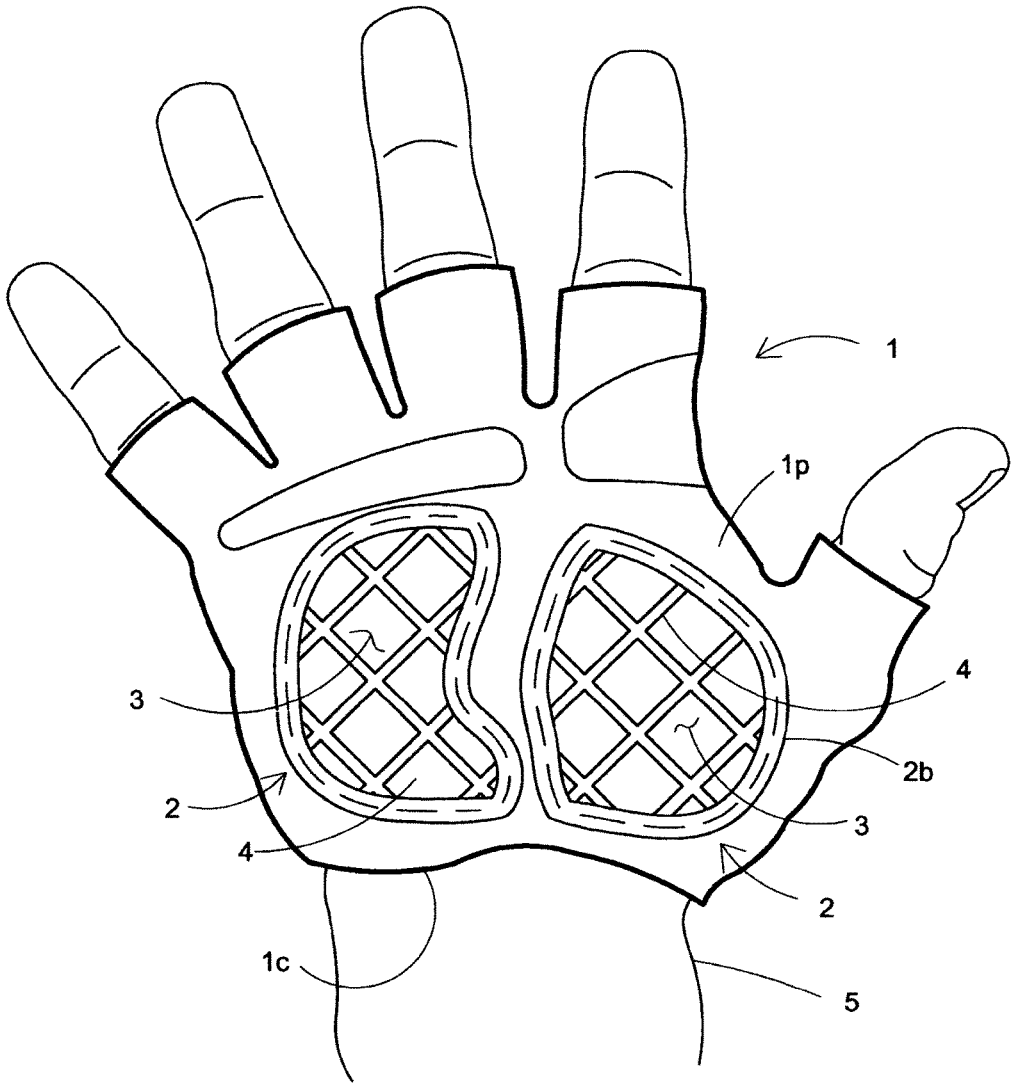
FIG. 1 is a plan view of a first embodiment of the glove with a portion of the outward facing layer omitted.
Figure 2A:
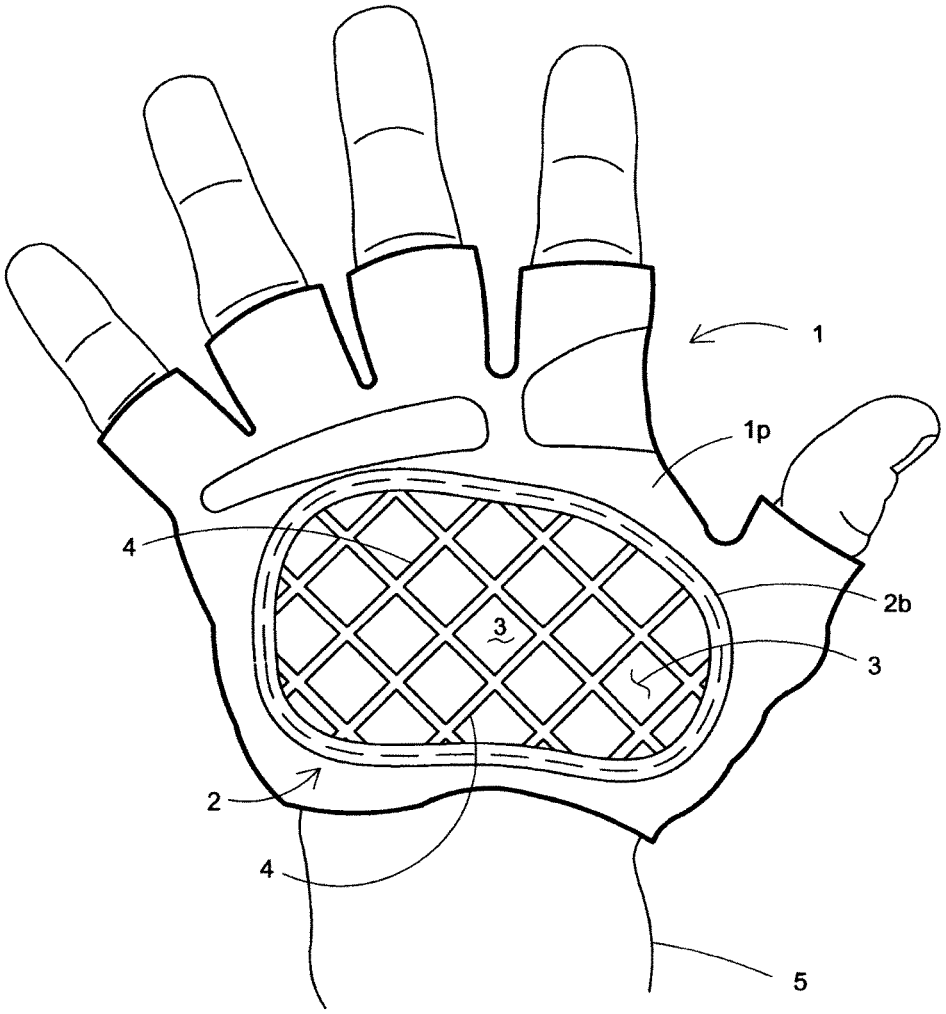
FIG. 2A is a plan view of another embodiment of the glove with a portion of the outward facing layer omitted.
Figure 2B:
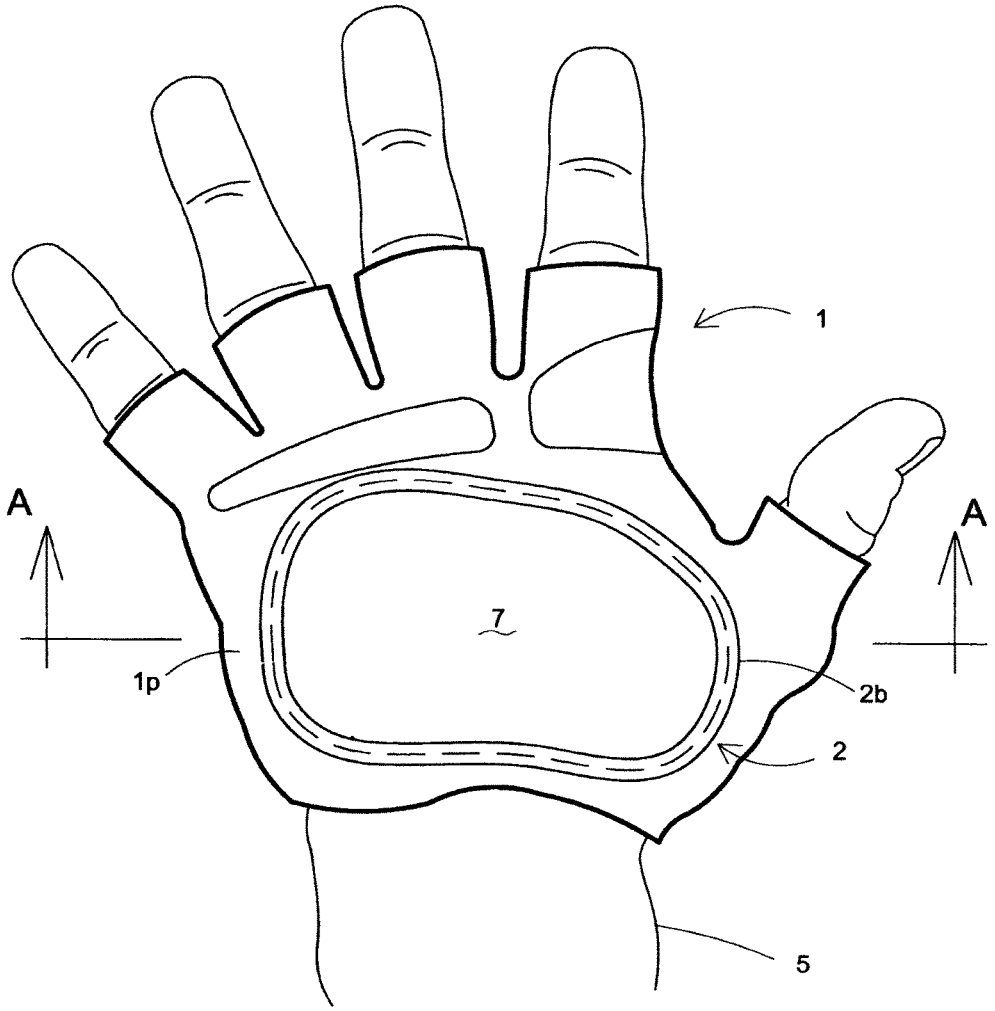
FIG. 2B is a plan view of the glove with the outward facing layer shown.

Referring now to the figures of the drawing in detail and first, particularly, to FIGS. 1 and 2 thereof, there is seen a glove/glove body 1 according to the invention. The glove 1 includes support regions 2 which are defined by a plurality of rigid plate elements 3 that are interconnected by a hinge 4 such as a living hinge. The support region(s) 2 are disposed at a palm area/portion 1*p* of the glove 1, which corresponds to a palm of a user's hands. The palm area 1*p* may have a circumferential border 2*b*. The glove 1 includes a cavity 1*c* for receiving a user's hand H. The cavity is at least partially defined by a palm wall 1*w*. The rigid plate elements 3 may be formed of plastic having a durometer of between 50 and 150 on the Rockwell R scale, which includes materials such as polypropylene, nylon, and polystyrenes etc. The use of the hinge 4 permits the support region 2 to flex, which prevents the support region 2 from pulling on other parts or areas of the glove 1 such as the area along the wrist 5 of a user when the glove 1 is placed against a handlebar 20. The hinge 4 further permits the support region 2 to contact the handlebar 20 with a larger surface area than a support region without hinges 4.

As discussed above, the hinge 4 may be provided as a living hinge (a hinge which results from a thinned portion of the material of the plate elements 3 as a result of injection molding). Alternatively, the hinge 4 may be provided by securely affixing the plate elements 3 to a fabric substrate. It is necessary that the hinge 4 is flexible enough to allow the plate elements 3 to conform or adjust to the handle bar 20 and a hand of a user wearing the glove 1. The conforming of the plate elements 3 allows the support region 2 to distribute the small area of pressure created at the handlebar 20 over a greater surface area without causing the glove 1 to be pulled uncomfortably in other areas or causing a Velcro® closure of the glove 1 to have extra stresses. Although the hinges 4 are shown aligned at right angles, it is possible to adjust the layout or orientation of the hinges 4 for different types of handlebars 20 (handlebars with different orientations with respect to the user, road bike handlebar, mountain bike handlebar, etc.) so that the flex of the support region 2 is as comfortable as possible. It is also possible for the plate elements 3 to have a more than four sides with hinges (polygonal or round/hemispherical) so as to provide flexibility in more directions and allow the glove to better conform in more directions.

The support regions 2 are sandwiched between an outer layer 7 such as leather or synthetic leather, which faces the handlebar 20 and a padding layer 8 (gel, foam, etc.) facing the hand of the user (between the support regions 2 and the cavity 1*c*. The padding layer 8 has an inner layer 9 such as leather or a synthetic layer, which defines the cavity 1*c* of the glove which directly contacts the hand of the user. The support region 2 allows the pressure of the handlebar 20 against the hand to be distributed to a larger surface area, which in turn allows the padding layer 8 to conform to the hand and not the handlebar 20. This prevents the padding layer 8 from wearing too quickly, as the padding actually pads the hands and not the handlebar. It is also possible to eliminate the padding layer 8 and to have the backside of the plate elements 3 directly contact the inner layer.

Figure 3:
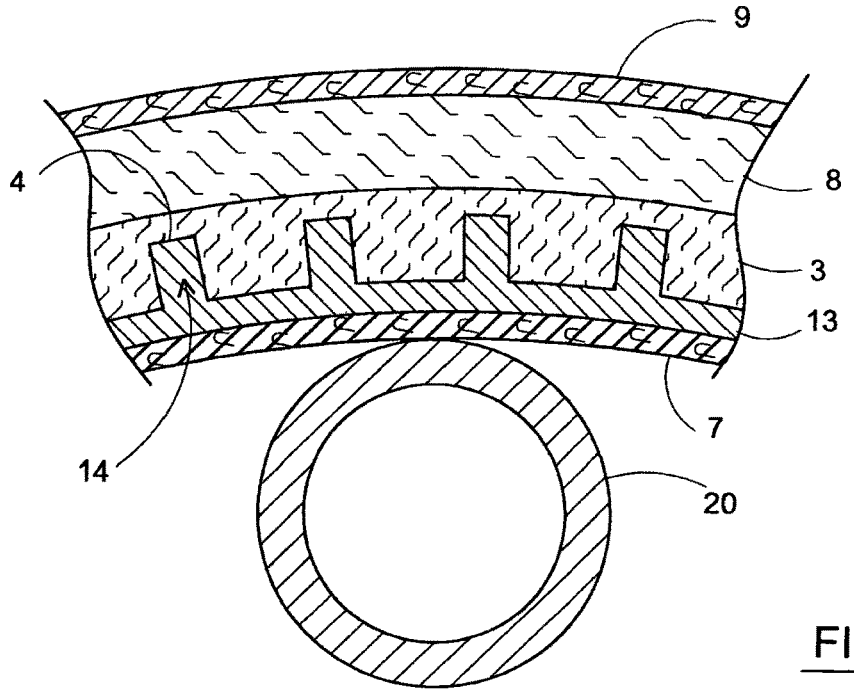
FIG. 3 is a cross-sectional view of the glove as it conforms to a handlebar.
Figure 4:
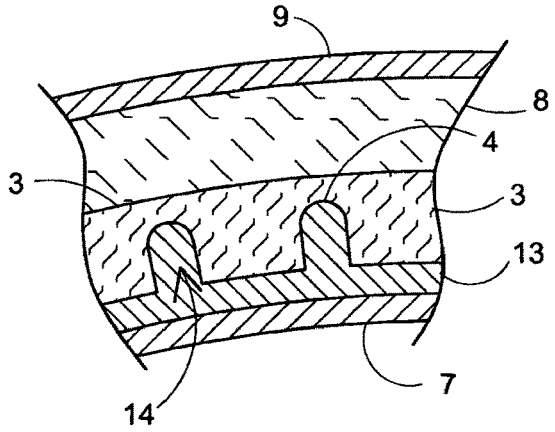
FIG. 4 is a partial cross-sectional view of another embodiment of the glove.
Figure 5:
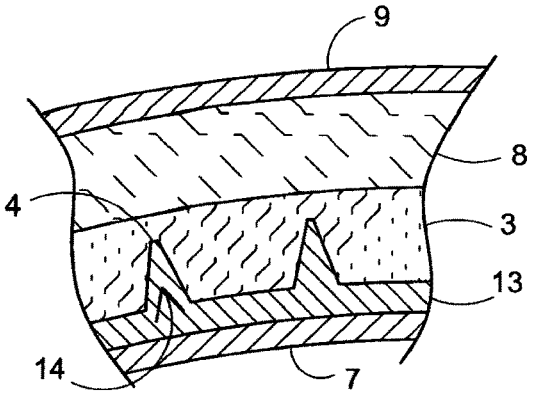
FIG. 5 is a partial cross-sectional view of a further embodiment of the glove.

When the hinge 4 is a living hinge, gaps 14 are provided between the individual plate elements 3 of the support region 2. The gaps 14 as shown in FIG. 3 have a rectangular shape. However, it is possible for the gaps 14 to have a triangular cross section with a radius at the top, in other words at the end of the gap 14 abutting the hinge, as shown in FIG. 5. Alternatively, a radius may be provided at the top of the rectangular shape to define that end of the gap, as shown in FIG. 4. Otherwise, corner radii can be provided in the corners of the rectangular shape.

Figure 6:
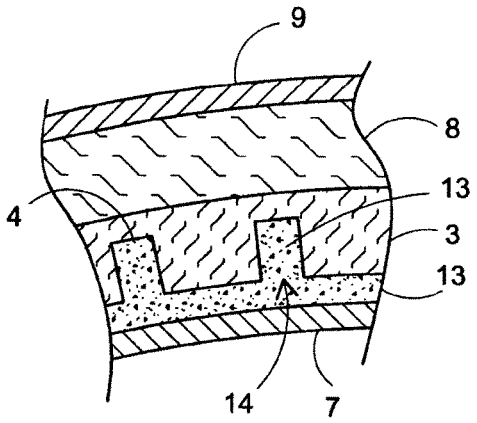
FIG. 6 is a partial cross-sectional view of a yet another embodiment of the glove.
Figure 7B:
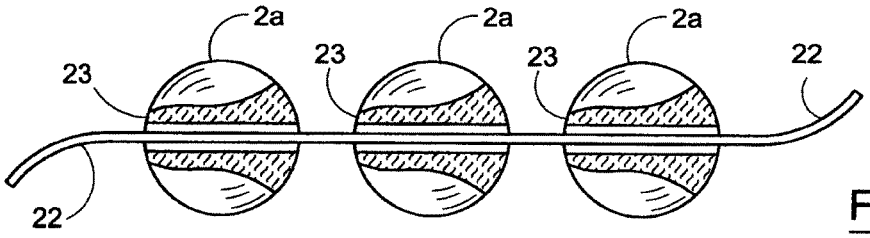
FIG. 7 is an enlarged partial cross-sectional view of still another embodiment of support elements.

In the case when a living hinge is provided as the hinge 4 it is possible to fill the gaps 14 of the support region 2 with an elastic material 13 such as a thermoplastic elastomer, gel, or rubber, as is shown in FIG. 6. Filling the gaps in this way reduces the flexibility of the support region 2, as the material 13 in the gaps 14 must be compressed to allow the hinge to flex. The filling of the gaps 14 also limits the travel of the individual plate elements 3, which results in increasing the durability of the support region 2. Also, in order to fill the gaps 14 it is possible for the elastic material 13 to be a continuous layer over the side of the support region 2 which faces the handlebar 20, in other words the areas of the support region 2 between the hinges 4.

FIGS. 7, 8, 9, and 11 to 13 illustrate another embodiment of the present invention. Here, the support regions 2 are provided with a plurality of discrete ball, round, or spherical shaped elements 2*a* disposed in a palm area 1*p* of the glove 1. The spherical shaped elements 2*a* can be considerably harder than conventional gel or foam cushion elements. A hardness value over 20 Shore A for the spherical shape elements 2*a* provides acceptable comfort and durability for the support regions. Preferably the hardness range for the spherical shape elements 2*a* is between 30 Shore A and 80 Shore D. A rubber ball shaped element 2*a* having a diameter of 4 to 6 mm and a hardness of 70 Shore A yielded favorable results in testing. Similarly a neoprene shaped element 2*a* having a diameter of 4 to 6 mm and a hardness of 87 Shore A yielded favorable results in testing. Surprisingly, it has been found in preliminary testing that the ball-shape of the support regions dramatically reduces numbness/tingling in the fingers of a user. The ball shaped elements 2*a* are illustrated as being substantially round, however it is also possible that they have an elliptical shape or have a flat side, such as a hemispherical. It is also possible that the ball shaped elements 2*a* can be pyramid shaped, triangular shaped, cube shaped, cylinder shaped, trapezoid shaped, parallelepiped shaped, tube shaped, bean shaped, capsule shaped or box shaped. The ball shaped elements may be disposed in other areas of the glove 1, such as areas corresponding to fingers of the glove 1.

Figure 8:
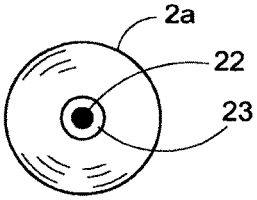
FIG. 8 is an end view of a support element of FIG. 7.
Figure 9:
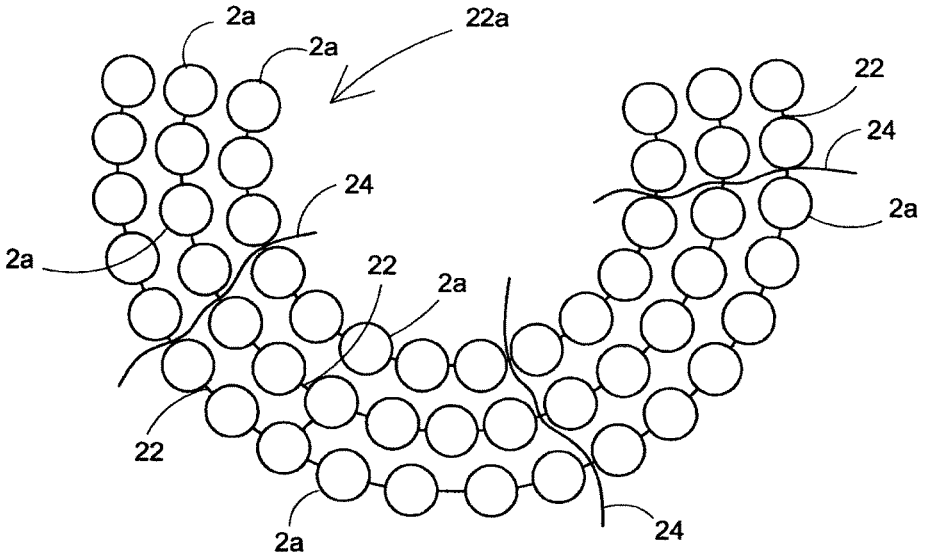
FIG. 9 is a plan view of an assembly of support elements using the support element shown in FIGS. 7 and 8.

The ball shaped elements 2*a* can be connected by a line or string 22 and disposed in a matrix pattern 22A within the support regions. The fact that the balls 2*a* are connected by the line 22 along with the shape of the ball shaped elements 2*a* allows exceptional movement between the ball shaped elements 2*a* which results in excellent flexibility of the glove thereby permitting the glove to conform to a handlebar without causing pulling of the glove in areas between the fingers. FIG. 8 shows that the balls 2*a* have a hole 23 allowing the line 22 to pass through and interconnect the ball shaped elements 2*a*. It is also possible for the ball shaped elements 2*a* to be molded directly onto the line 22 or onto a mesh pattern of lines 22. FIG. 9 shows an assembly of the ball shaped elements 2*a* constructed for being placed into the palm area 1*p* of the glove 1, wherein the support area 2 would be U-shaped. Additional lines or strings 24 are connected to and cross the lines 22 to prevent the ball shaped elements 2*a* from shifting and causing the lines 22 to cross one another. FIG. 9 also illustrates that the ball shaped elements 2*a* connected by the line 22 provides exceptional flexibility for constructing various shapes to accommodate specific support areas 2 of the glove 1. Other shapes can be recognized in the preceding figures of the instant application.

Figure 10A:
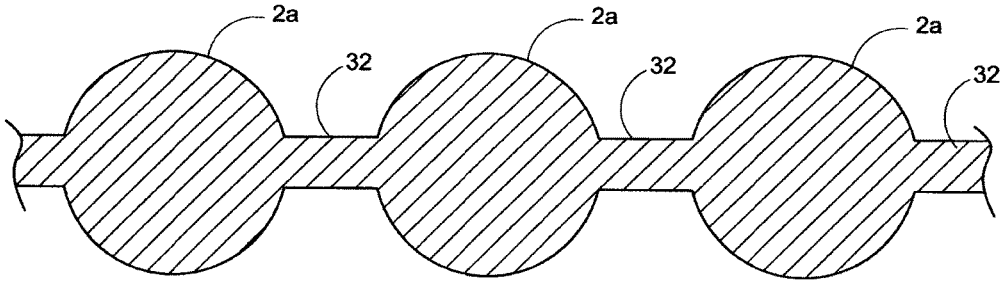
FIG. 10A is a partial cross-sectional view of yet another embodiment of support elements.
Figure 10B:
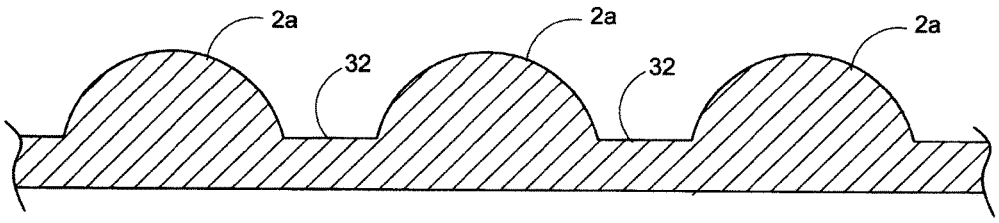
FIG. 10B is a partial cross-sectional view of a still yet another embodiment of support elements.

FIG. 10A shows that the ball shaped elements 2*a* are provided as hemispheres which can be molded as projections of a flexible substrate 32 in matrix pattern 22*a*, wherein the flexible substrate 32 is a living hinge between the hemispheres 2*a*. It is also possible for the hemispheres to only be provided on one side of the substrate 32 so that the opposite side of the substrate is smooth as shown in FIG. 10B. It is preferable that the hemispheres 2*a* be directed towards the cavity 1*c* which accommodates the user's hand H.

Figure 12:
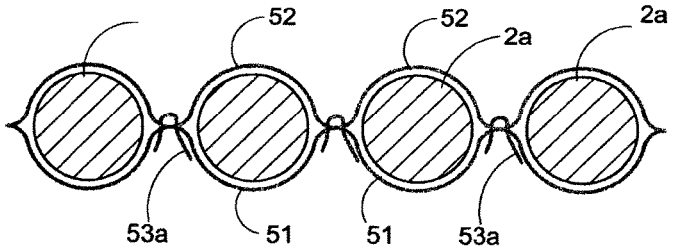
FIG. 12 is a sectional view along line 12-12 in FIG. 11.
Figure 11:
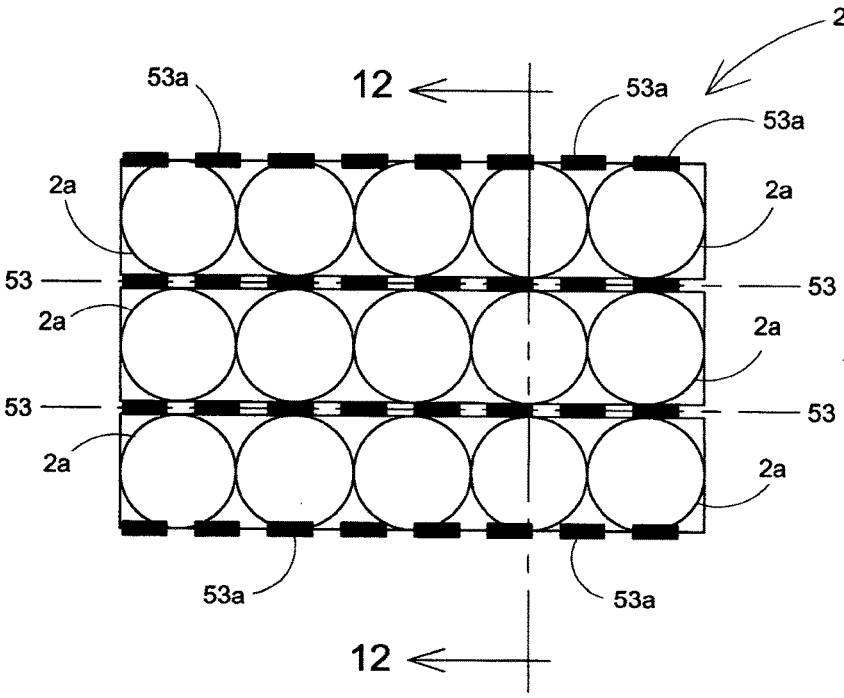
FIG. 11 is a plan view of an alternate embodiment of support elements inserted into tubes.
Figure 13:
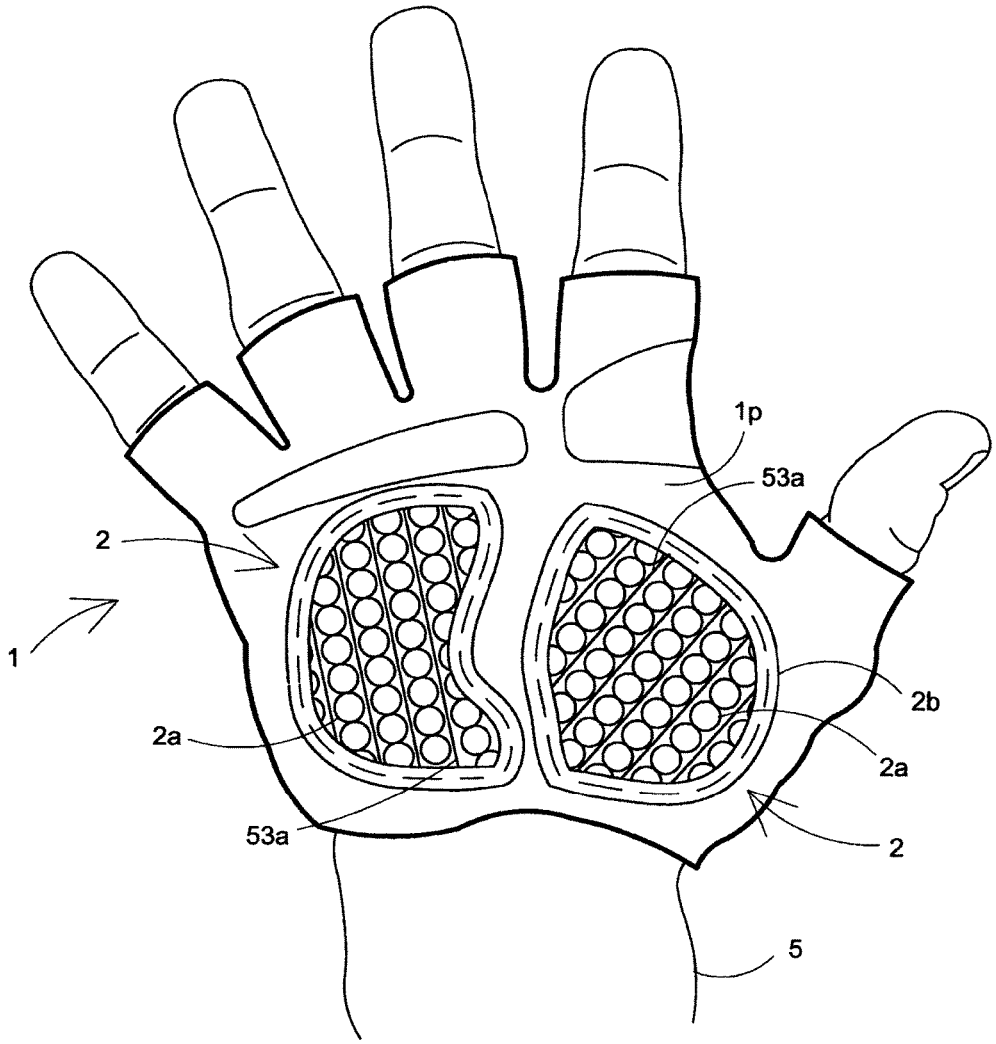
FIG. 13 is a plan view of the glove having the support elements of FIGS. 11 and 12 and the outward facing layer omitted.

FIGS. 11 and 12 show an alternate embodiment of disposing ball shaped elements 2*a* in flexible tunnels or tubes 50. The tunnel 50 has a diameter slightly greater than the diameter of spheres 2*a*. The tunnels 50 may be constructed by a first substrate 51 affixed to a second substrate 52 along longitudinal lines 53. This may be achieved by using stitching 53*a* to attach the first substrate 51 to the second substrate 52. In this embodiment, ball shaped elements 2*a* are inserted into tunnels 50 and the substrate 51 or 52 is attached to the glove 1 in desired areas or support areas 2, as is shown in FIG. 13. The attachment of the substrates 51 or 52 may be by an adhesive backing on the substrate 51 or 52, which affixes the matrix pattern 22*a* to retrofit a glove 1. Although not explicitly shown, the ball shaped elements 2*a* can also be disposed along with a padding layer 8 between an inner layer 9, and an outer layer 7, as described above with respect to the embodiments shown in FIGS. 3-5.

In the matrix 22*a*, at least some of the ball shaped elements 2*a* are disposed such that ball shaped elements 2*a* directly adjacent to one another are disposed such that the adjacent surfaces thereof are within a distance a of less than a diameter of the ball shaped elements 2*a* at the nearest point thereof. Preferably, the ball shaped elements 2*a* are disposed such that at least some of the ball shaped elements 2*a*, which are disposed directly adjacent to one another contact one another at a contact point/surface between the ball shaped elements 2*a*.

It is preferable for the ball shaped elements 2*a* to be a rubber, neoprene, thermoplastic elastomer or other elastomeric material. However, the ball shaped elements 2*a* may also be made of compressed roller, plastic or other compatible materials which meet the hardness and durability requirements for the glove. It is also preferable that the ball shaped elements 2*a* of the diameter in the range of 2 mm-12 mm. Particularly, a range of 4 mm-8 mm has been found to be very effective.

An alternative embodiment of the present invention relates to a pad for contact at pressure locations where there is pressure applied between a body part and a surface.

The pad contacts pressure locations. Such pressure locations include a seat such as a bicycle seat, shoe insoles or socks at the ball of the foot and at the heel, clothing such as pants in the buttock area, and knee pads. The pressure pad is for incorporation into the above items or can be added afterwards to any pressure location by use of an adhesive or by insertion within a closable pocket.

A pad containing balls arranged in a matrix pattern is provided. Now referring to FIG. 14 showing a plan view of a bicycle seat 50 having support areas 2 generally located in a position which contacts the sit bones of a rider or user.

Figure 15:
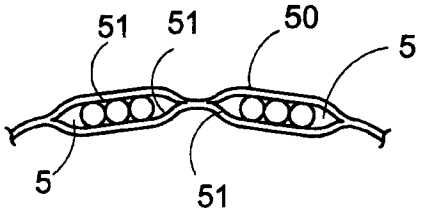
FIG. 15 is a cross sectional view taken along line 15-15 of FIG. 14.
Figure 14:
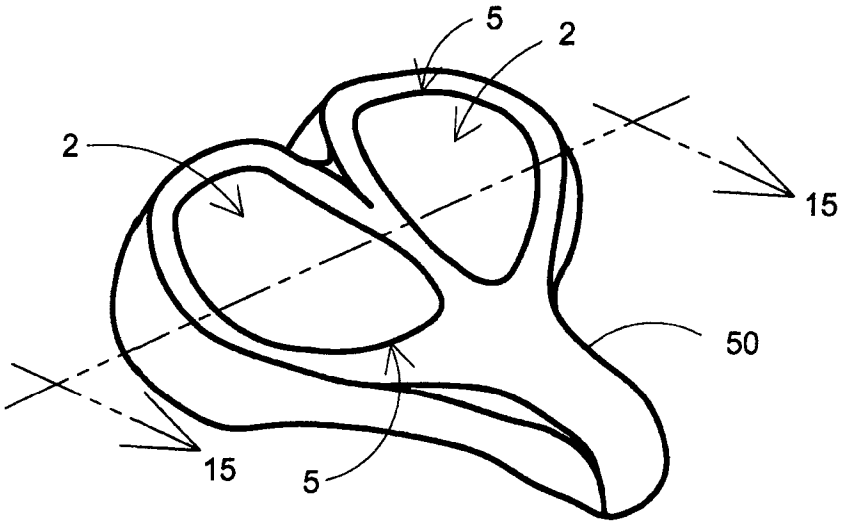
FIG. 14 is a plan view of a bicycle seat.

FIG. 15 is a cross sectional view taken along line 15-15 of FIG. 14 where the seat 50 is shown and balls 2*a* can be seen within a walled containment 51 for retaining balls 2*a*. Balls 2*a* have freedom to move within walled containment 51. The walled containment 51 may include a medium such as a liquid or a gel to suspend the balls 2*a* therein.

Figure 16:
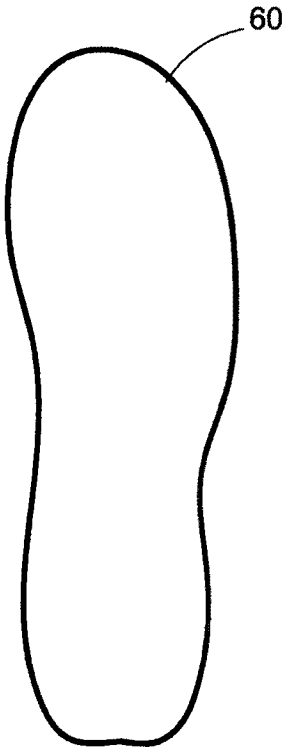
FIG. 16 is a plan view of a shoe insole.

FIG. 16 is a plan view of a shoe insole 60*a*.

Figure 17:
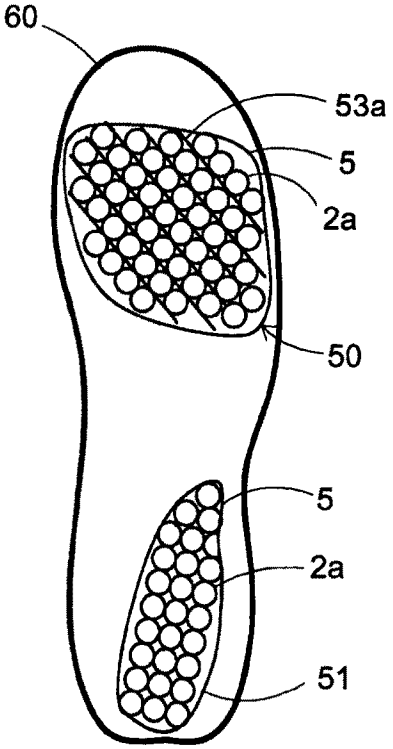
FIG. 17 is a plan view with cutaway views of the shoe insole of FIG. 16.

FIG. 17 is a plan view with cutaway openings showing the balls 2*a* in the respective heel and ball areas of the foot of the shoe insole with a pad 5 containing balls 2*a*, arranged in a matrix within tunnels 50 with stitching 53*a* as previously disclosed or in the walled containment 51.

Figure 18:
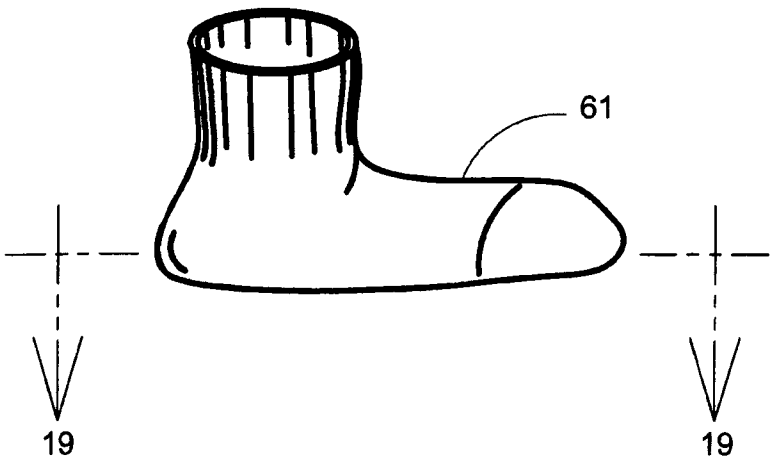
FIG. 18 is a perspective view of a sock.

FIG. 18 is a perspective view of a sock 61.

Figure 19:
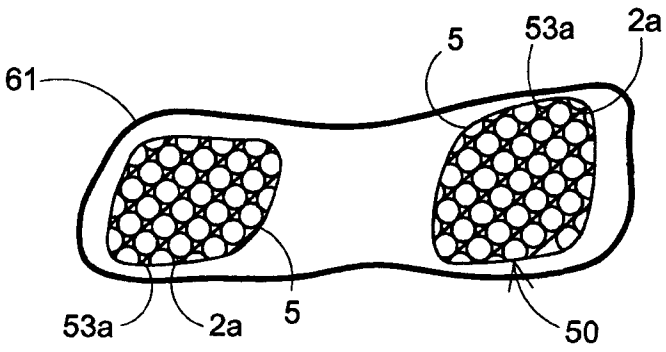
FIG. 19 is a plan view with a cutaway views of FIG. 18.

FIG. 19 is a plan view with a cutaway view showing the balls 2*a* in the respective heel and ball areas of the foot of the sock with a pad 5 containing balls 2*a*, arranged in a matrix within tunnels 50 with stitching 53*a* as previously disclosed or in the walled containment 51.

Figure 20:
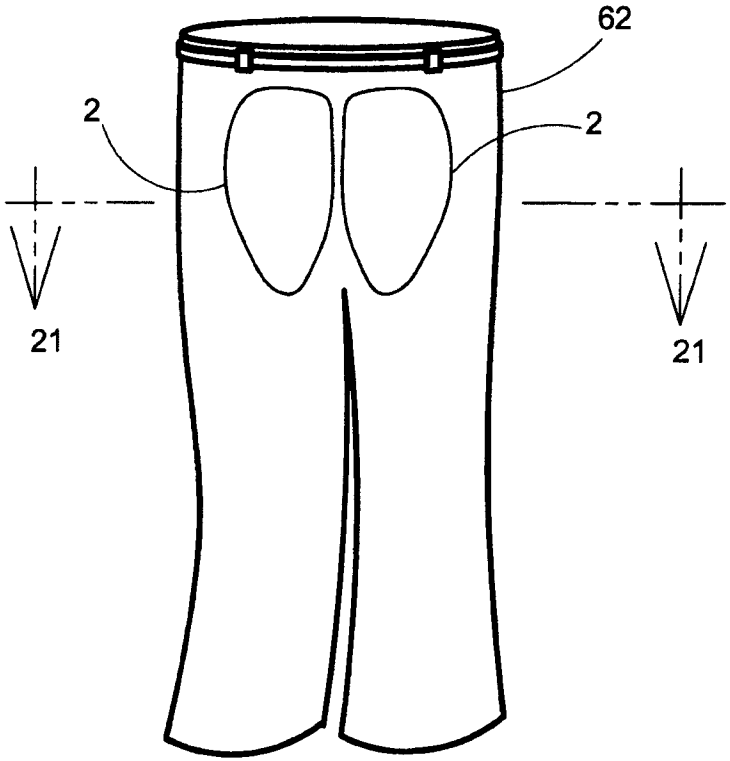
FIG. 20 is a rearview of a pair of pants.

FIG. 20 is a rearview of a pair of pants 62 having support areas 2.

Figure 21:
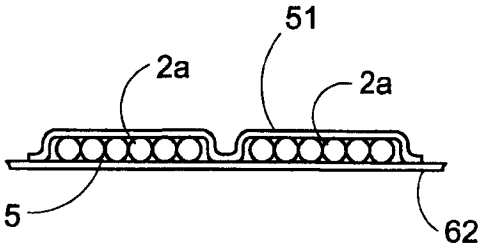
FIG. 21 is a cross sectional view along line 21-21 of FIG. 20.

FIG. 21 is a cross sectional view along lines 21-21 through support areas 2 of FIG. 20, showing the balls 2*a* within the walled containment 51.

Figure 22:
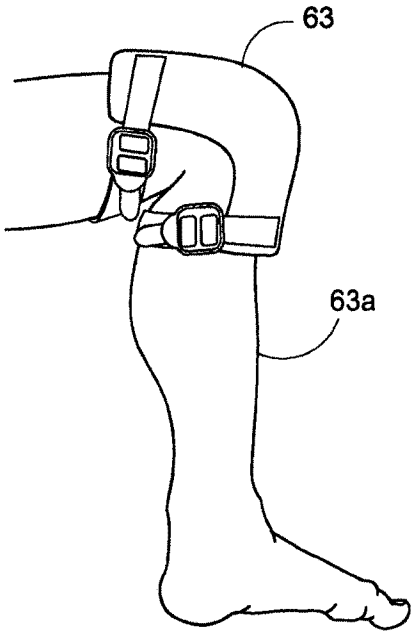
FIG. 22 is a side view of a leg having a knee pad.

FIG. 22 is a side view of a leg 63*a* having a knee pad 63 with straps and connectors 63*b*.

Figure 23:
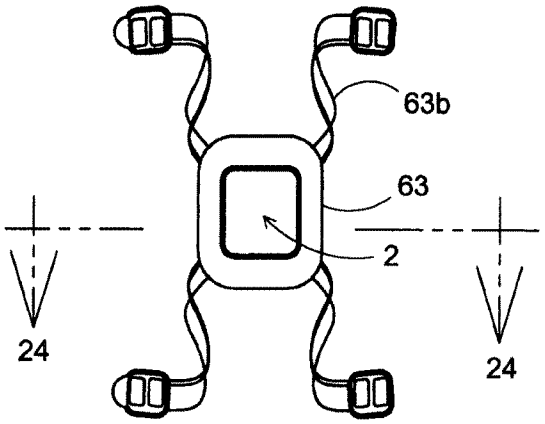
FIG. 23 is a plan view of the knee pad of FIG. 22.

FIG. 23 is a plan view of the knee pad showing the location of support area 2.

Figure 24:
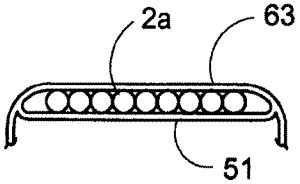
FIG. 24 is a cross-sectional view taken from FIG. 23 along line 24-24.

FIG. 24 is a cross-sectional view taken from FIG. 23 along line 24-24 showing pad 5 with balls 2*a* within the walled containment 51.

Figure 26:
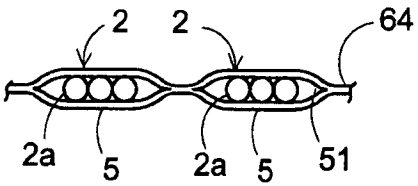
FIG. 26 is a cross section from FIG. 25 taken along the lines 26-26.
Figure 25:
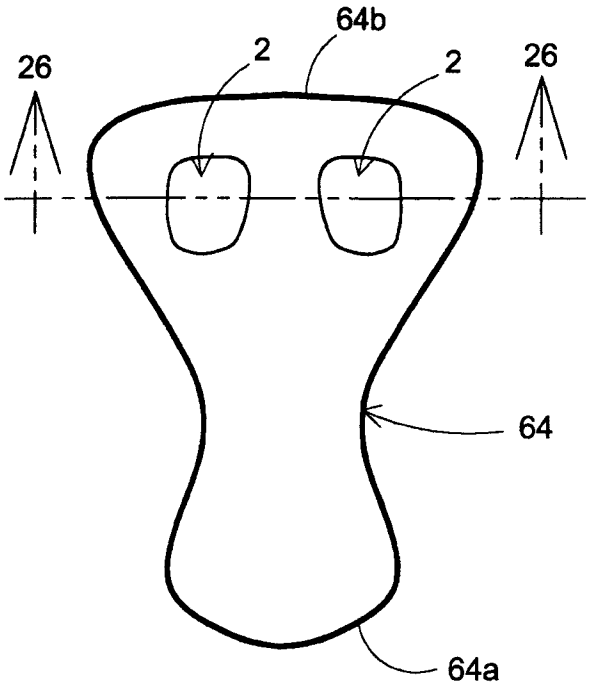
FIG. 25 is a plan view of a chamois insert.

FIG. 25 is a plan view of a chamois insert 64 for bicycle shorts having support areas 2;

FIG. 26 is a cross section of the chamois insert 64 of FIG. 25 taken along the lines 26-26, where pad 5 has balls 2*a* within the walled containment 51.

Figure 27:
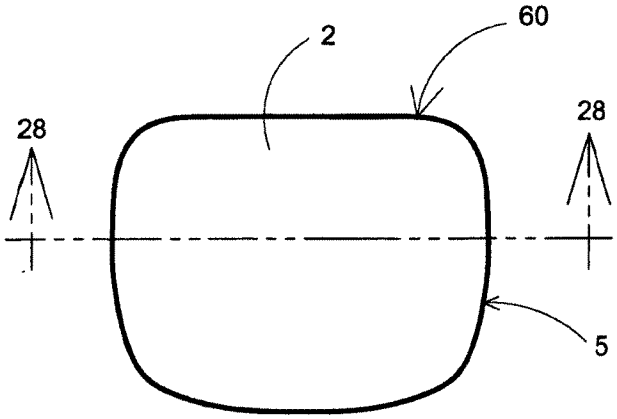
FIG. 27 shows a plan view of a pad cut to a specification.

FIG. 27 shows a plan view of a pad 60 with balls cut to specifications for the required application within a pad 5 that is disposed into gloves or into the support area 2 of any of the above heretofore described items.

Figure 28:
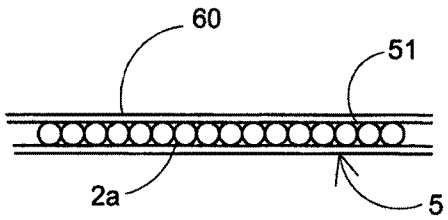
FIG. 28 is a cross section view along lines 28-28 taken from FIG. 27.

FIG. 28 is a cross section along lines 28-28 taken from FIG. 27 showing the walled containment 51 and balls 2*a* disposed therein.

Figure 29:
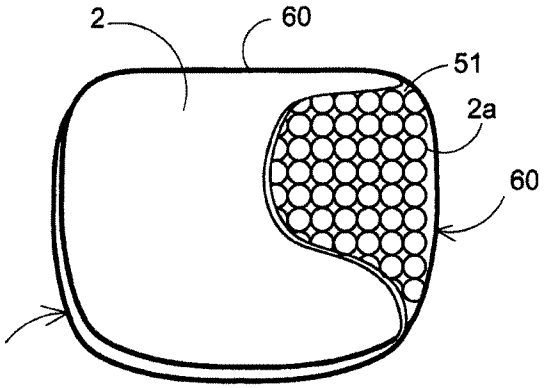
FIG. 29 is a top perspective view of the pad of FIG. 27 with a cutaway view.

FIG. 29 is a top perspective view of the pad 5 of FIG. 27 showing a portion of the inside of the pad 5, having balls 2*a* arranged in a matrix disposed within the walled containment 51.

Figure 30:
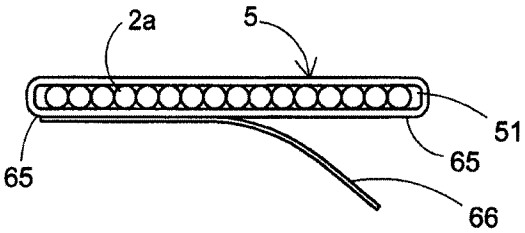
FIG. 30 shows a cross-sectional view of specification pad with an adhesive and liner.

FIG. 30 shows a cross-sectional view of pad 60 made to the specification of the required application with pad 5 having balls 2*a* arranged in a matrix within a walled containment 51, further including on at least one side an adhesive 65 and a removable liner 66. The pad 60 is for application at a desired pressure location using the adhesive to hold the pad 5 in place at a desired location. Alternatively the pad 5 can include areas (openings) for allowing stitching to affix the pad 60.

Figure 31:
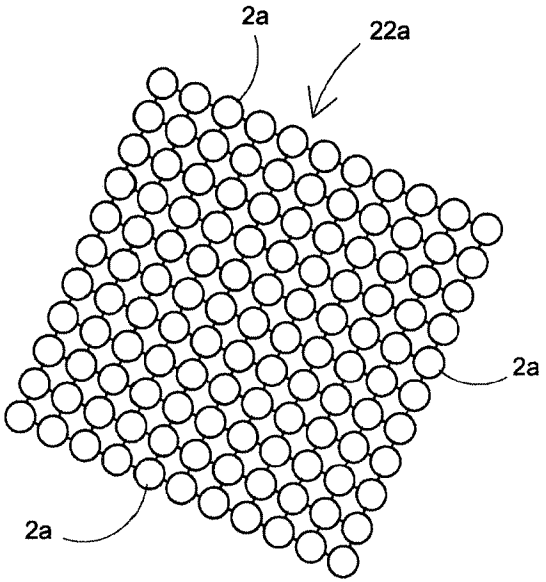
FIG. 31 shows a plan view of a matrix pattern of interconnected neighboring balls.

FIG. 31 shows a plan view of an 11×11 matrix pattern 22*a* of balls 2*a* where neighboring balls are connected.

Figure 32:
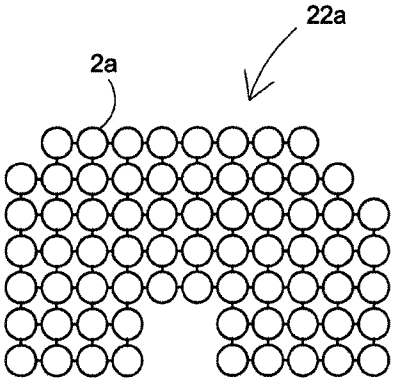
FIG. 32 shows a plan view of balls disposed in a matrix pattern shaped to a specification.
Figure 33:
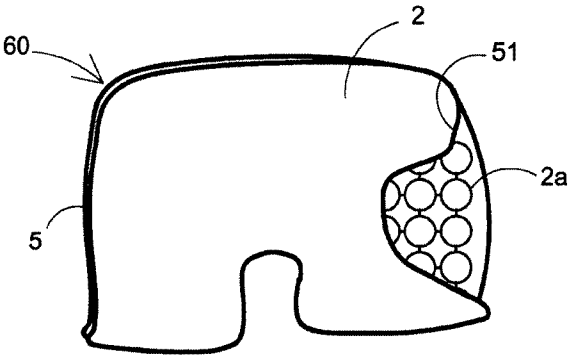
FIG. 33 is a plan view of the specification pad with a cutaway view.

FIG. 32 shows a plan view of balls 2*a* disposed in a matrix pattern 22*a* that is shaped to the specification of the required application for a pad 60 and placement in a padding area as shown in FIG. 33.

FIG. 33 is a plan view of the pad 60 showing a portion of the inside of the padding area, having balls 2*a* arranged in a matrix 22*a* disposed within the walled containment 51.

Figure 34:
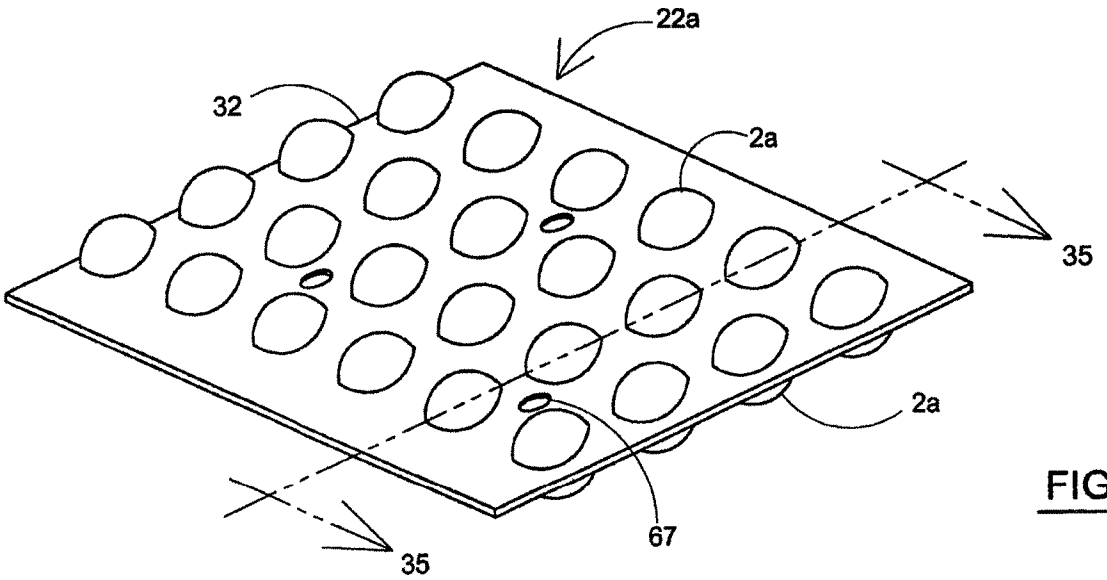
FIG. 34 is a plan view of a matrix pattern of balls where neighboring balls are connected with a web or living hinge.

FIG. 34 shows a plan view of a 4×6 matrix pattern 22*a* of balls 2*a* where neighboring balls are connected with living hinges 32.

Figure 35:
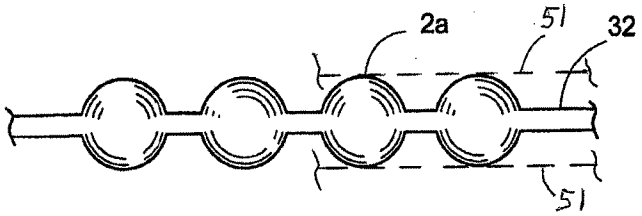
FIG. 35 (similar to FIG. 10A) is a cross section taken from FIG. 34 along lines 35-35.

FIG. 35 (similar to FIG. 10A) is a cross section of FIG. 34 of matrix pattern 22*a*, where the distance between balls 2*a* is less than a diameter of the ball 2*a* and vent openings 67 are disposed in the web or hinged area 32.

In pad 60, the shape of the matrix pattern 22*a* would be shaped to a third party's specifications.

We claim:

1. A support element comprising:

a padding structure constructed of a plurality of interconnected spherical shaped structures together defining a pliable support element;

said spherical shaped structures being formed of a material and being interconnected to one another with a connection defining flexible interconnectors for enabling said padding structure to be flexibly bent, said connection being a living hinge formed with said material of said spherical shaped structures; and a walled containment, said padding structure being disposed within said walled containment.

2. The support element according to claim 1, wherein at least some of said spherical shaped elements are hemispherical.

3. The support element according to claim 1, wherein at least some of said interconnected spherical shaped structures are hemispherical projections substantially disposed in a matrix pattern.

4. The support element according to claim 3, wherein said spherical shaped elements each have a respective center and diameter, directly adjacent ones of said spherical shaped elements are disposed with said centers spaced apart by a distance greater than twice said diameter.

5. A support element comprising:

a padding structure constructed of a plurality of interconnected spherical shaped structures together defining a pliable support element;

said spherical shaped structures being interconnected to one another with a connection defining flexible interconnectors for enabling said padding structure to be flexibly bent;

said spherical shaped elements each having a respective center and diameter, directly adjacent ones of said spherical shaped elements being disposed with said centers spaced apart by a distance less than twice said diameter; and a walled containment, said padding structure being disposed within said walled containment.

6. A support element comprising:

a padding structure having a pliable support element with a first side and a second side, said first side having a plurality of hemispherical shaped structures formed thereon, said second side having a plurality of hemispherical shaped structures formed thereon, said hemispherical shaped structures formed of a material;

said pliable support element defining flexible interconnectors connecting said hemispherical shaped structures to one another and enabling said padding structure to be flexibly bent, said flexible interconnectors being a living hinge formed with said material of said hemispherical shaped structures; and a walled containment, said padding structure being disposed within said walled containment.

7. A support element comprising:

a padding structure constructed of a plurality of interconnected ball shaped structures together defining a pliable support element, said padding structure having vent openings formed therein;

said ball shaped structures being formed of a material and being interconnected to one another with a connection defining flexible interconnectors for enabling said padding structure to be flexibly bent, said connection being a living hinge formed with said material of said ball shaped structures.

* * * * *